US006288682B1

(12) United States Patent
Thiel et al.

(10) Patent No.: US 6,288,682 B1
(45) **Date of Patent: *Sep. 11, 2001**

(54) DIRECTIONAL ANTENNA ASSEMBLY

(75) Inventors: David Victor Thiel; Steven Gregory O'Keefe; Jun Wei Lu, all of Queensland (AU)

(73) Assignee: Griffith University, Queensland (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/469,595

(22) Filed: Dec. 22, 1999

Related U.S. Application Data

(63) Continuation-in-part of application No. 08/557,031, filed on Mar. 14, 1996, now Pat. No. 6,034,638.

(30) Foreign Application Priority Data

Aug. 2, 1999 (AU) ..... PQ1980

(51) Int. Cl.[7] ..... H01Q 1/24

(52) U.S. Cl. ..... 343/702; 343/815; 343/841; 343/873

(58) Field of Search ..... 343/700 MS, 702, 343/815, 818, 841, 873

(56) References Cited

U.S. PATENT DOCUMENTS

| | | | |
|---|---|---|---|
| 3,268,896 | | 8/1966 | Spitz et al. . |
| 3,541,567 | | 11/1970 | Francis et al. . |
| 3,560,978 | | 2/1971 | Himmel et al. . |
| 3,725,938 | | 4/1973 | Black et al. . |
| 4,123,759 | | 10/1978 | Hines et al. . |
| 4,170,759 | | 10/1979 | Stimple et al. . |
| 4,356,492 | | 10/1982 | Kaloi . |
| 4,367,474 | | 1/1983 | Schaubert et al. . |
| 4,379,296 | | 4/1983 | Farrar et al. . |
| 4,414,550 | | 11/1983 | Tresselt . |
| 4,631,546 | | 12/1986 | Dumas et al. . |
| 4,700,197 | | 10/1987 | Milne . |
| 4,800,392 | | 1/1989 | Garay et al. . |
| 4,812,855 | * | 3/1989 | Coe et al. ..... 343/818 |
| 5,008,681 | * | 4/1991 | Cavallaro et al. ..... 343/700 MS |
| 5,075,691 | | 12/1991 | Garay et al. . |
| 5,220,335 | * | 6/1993 | Huang ..... 343/700 MS |
| 5,243,358 | | 9/1993 | Sanford et al. . |
| 5,338,896 | | 8/1994 | Danforth . |
| 5,373,304 | | 12/1994 | Nolan et al. . |
| 5,420,596 | * | 5/1995 | Burrell et al. ..... 343/700 MS |
| 5,507,012 | | 4/1996 | Luxon et al. . |
| 6,034,638 | | 3/2000 | Thiel et al. . |

FOREIGN PATENT DOCUMENTS

| | | |
|---|---|---|
| 0 214 806 A2 | 3/1987 | (EP) . |
| 0 588 271 A1 | 3/1994 | (EP) . |
| 2 216 726 A | 10/1989 | (GB) . |
| 2 227 370 A | 7/1990 | (GB) . |
| WO 94/28595 A1 | 12/1994 | (WO) . |

* cited by examiner

*Primary Examiner*—Tan Ho
(74) *Attorney, Agent, or Firm*—Jenkins & Wilson, P.A.

(57) ABSTRACT

A directional antenna assembly includes a dielectric structure having a surface. An array of wire antenna elements is positioned within or on the surface of the dielectric structure. At least one of the wire antenna elements is active, and the remainder of the wire antenna elements are passive.

32 Claims, 18 Drawing Sheets

DIRECTIONAL ANTENNA ASSEMBLY

RELATED APPLICATIONS

The subject application is a continuation-in-part application of U.S. patent application Ser. No. 08/557,031, filed Mar. 14, 1996 now U.S. 6,034,638.

FIELD OF THE INVENTION

The present invention relates to antennas for use in portable communications devices and particularly to a directional antenna assembly.

DESCRIPTION OF THE PRIOR ART

The prior art in relation to antennas covers a broad spectrum. Antennas are used in a wide variety of applications both as transmitters and receivers of electromagnetic energy. One important consideration in many of these applications is the directivity of the antenna. It is generally desirable to maximise the directional properties of the antenna. This has been achieved in the prior art arrangements by techniques such as reflector screens, multiple antenna arrays, electronically steerable antennas and reflector elements.

Optimised antenna directivity is of particular concern in the area of mobile cellular communications. Improved directivity increases the range of mobile cellular telephones in relation to a cell site, and reduces the interference between adjacent cells. A reduction in power consumption, and hence less demand on the mobile telephone battery, also results from improved directivity of the antenna.

There are also presently concerns about the safety of mobile cellular telephones for users. Human tissue is a very good conductor of electricity, even at high frequencies, and it has been suggested that health problems may occur with prolonged use of such devices for reason of the antenna being very close to the user's skull resulting in very high strength electromagnetic fields concentrated about the antenna penetrating the skull and damaging brain tissue. The IEEE has published Technical Standard No. C95.3 in relation to recommended maximum exposure to electromagnetic radiation from antennas. A directional antenna can minimise the radiation directed towards the user, and from this point of view is most desirable.

Reduced exposure to mobile telephone radiation can also be achieved through the use of shielding devices. Such shields seek to protect the user by reducing the amount of radiation that is emitted towards the head of the user. However, there is a trade-off in that the absorbed energy is not used in transmission, thus reducing the overall efficiency of the mobile telephone. A further disadvantage of this method is that there is a certain amount of microwave energy that is diffracted around the edges of the shield. This diffracted energy reduces the effectiveness of the shield and therefore reduces the amount of protection that is given to the mobile telephone user.

The overall size of the antenna apparatus is another important consideration, particularly as electronic communications devices become ever more miniaturised. Large antenna apparatus are undesirable for reasons of portability, mechanical stability and appearance. Size is also an important consideration in achieving increased antenna directivity. In free space, the distance between radiating elements/reflectors is a substantial part of one free space wavelength of the radiation in air. This means that the antennas may be relatively large in more than one direction if directionality is required.

Reference also can be made to International Publication No. WO 94/28595 (equivalent to Australian Patent No. 679992) that discloses forms of physically small antennas.

It is a principal object of the present invention to provide a directional antenna that provides protection to the user against electromagnetic radiation. It is a further, secondary object of the invention to provide a directional antenna that is physically small compared with prior art arrangements.

SUMMARY OF THE INVENTION

Therefore, the invention discloses a directional antenna assembly arrangement comprising:

a dielectric structure having a surface; and an array of wire antenna elements positioned within or on the surface of the dielectric structure, at least one of the wire antenna elements being active and the remainder being passive.

The dielectric structure can be formed from a material having a dielectric constant of greater than four, or preferably greater than ten. Switching means, connected to the antenna elements is operable to selectively switch one or more of the antenna elements to be active, while the passive elements are switched to be electrically connected to ground or in a circuit condition. The switching can be directed by a direction of greatest signal strength. The antenna elements can be in a symmetric array. Further, the dielectric structure can be a hollow or solid cylinder, or a rectangular body.

In accordance with another aspect of the present invention, there is provided an antenna assembly including at least:

a substantially planar structure of dielectric material, and an array of at least three antenna elements mounted on a common surface of said structure, the array including an active element having a feed connection point, a first passive element being parallel with and spaced apart from the active element, and a second passive element being parallel with and spaced apart from the first active element in an opposed direction to said first passive element.

In one advantageous form, said antenna elements are substantially elongate. Furthermore, said second passive element has a transverse portion substantially L-shaped, and of greater length than the active element to act as a reflector, and said L-shaped second passive element is arranged to at least partially surround the active element. The first passive element can be equal or lesser length than the active element to act as a director. The second passive element passes through said dielectric structure and extend over at least a portion of the opposed surface of the structure. Furthermore, the feed point of the active element is electrically connected with a centre conductor of a coaxial feed line, being at one end of the active element. The second passive element is electrically connected to a signal ground conductor of the coaxial feed line.

The invention further discloses a communications device having an antenna assembly as described immediately above. In a preferred embodiment, the antenna assembly is mounted from the communications device in a manner such that the plane of the array is perpendicular to a user's head, with the second passive element being proximate thereto. The antenna assembly is mounted from the communications device in a manner such that the antenna assembly can pivot about its base.

Embodiments of the invention provide an antenna that has less absorption by the user's head, increased signal strength due to improved directionality and a minimal change in antenna impedance with the user's head position than those in the prior art. This then results in a reduction in power consumption of the electronic equipment to which the antenna is coupled (eg. a cellular telephone). There further is an associated health benefit, since the electromagnetic energy absorbed by the user's head will be at a lower level than in the prior art.

One other specific advantage is that, because the antenna assembly can be directly substituted for prior art antennas in portable communications devices, the foregoing benefits are gained without a need to replace the otherwise expensive device. In one example, a physically smaller antenna having improved directivity can be substituted for an existing antenna in a cellular telephone. Thus the telephone casing can further be reduced in size to provide the user with greater portability.

A further specific advantage is that the antenna assembly is capable of being arranged so as to fold down alongside a telephone casing further reducing the overall size of the device and further providing greater portability.

BRIEF DESCRIPTION OF THE DRAWINGS

Embodiments of the invention will now be described with reference to the accompanying drawings, in which.

DETAILED DESCRIPTION OF THE PREFERRED EMBODIMENTS

The embodiments will be described with reference to mobile cellular telecommunications. It is to be appreciated, however, that the invention is equally applicable to radio communications in general, including electromagnetic geophysics, radar systems and the like.

One method of reducing the influence on reception and transmission performance of an antenna associated with a portable communications device by the user's head is to shield the antenna from the head. In prior art arrangements, however, a conductive sheet acting as a shield cannot be located closer than one quarter-wavelength from an antenna without degrading the efficiency of the antenna.

Figure 1A:
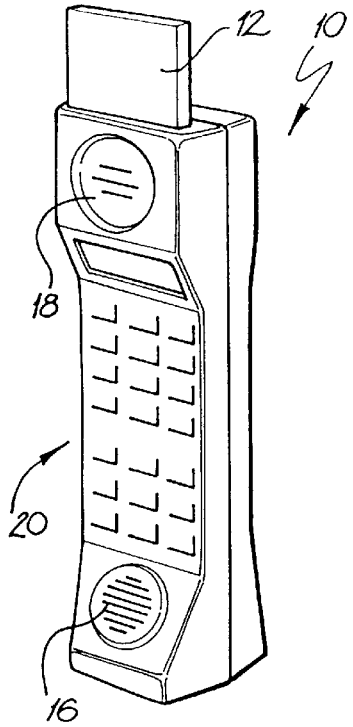
FIGS. 1*a*, 1*b* and 1*c* show a cellular telephone incorporating a shielded antenna structure.
Figure 1B:
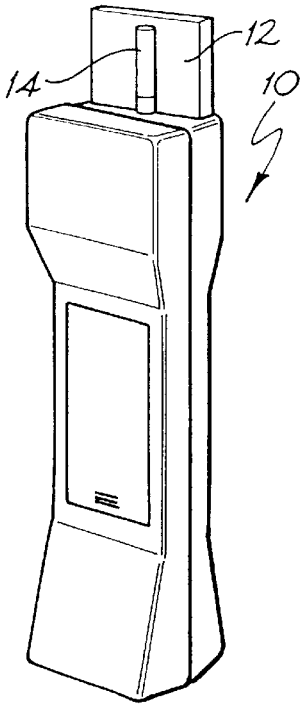
Figure 1C:
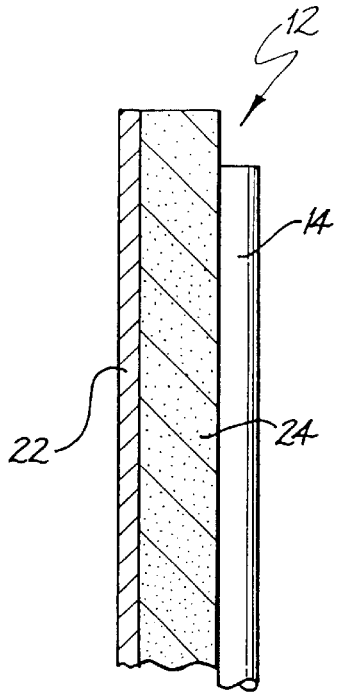

FIGS. 1*a*, 1*b* and 1*c* show a shielded antenna arrangement for a mobile telephone that allows the shield to be physically close to the antenna, contrary to prior art arrangements.

The antenna arrangement is constructed as a composite or sandwiched structure 12, as best shown in the partial cross-sectional view of FIG. 1*c*. The structure 12 comprises a conductive sheet 22, an intermediate layer of high dielectric constant low loss material 24 and a monopole antenna 14. The conductive sheet 22 typically is constructed of a thin copper sheet, whilst the dielectric material 24 typically is of alumina, which has a relative dielectric constant $\in_r > 10\in_0$. The conductive sheet 22 is located closest to the 'user' side of the mobile telephone 10, being the side having the microphone 16, earspeaker 18 and user controls 20, and therefore shields the user's head in use of the mobile telephone.

The effect of the dielectric material 24 is to allow the conductive back plane 22 to be physically close to the antenna 12 without adversely affecting the antenna's efficiency. By utilising a material with a relative dielectric constant>10 $\in_0$, and choosing the thickness of the dielectric material 24 to be $<\lambda/(2\sqrt{\in_r})$, the 'image' antenna is in phase with the radiating antenna 14 in the direction away from the conductive sheet 22. Thus the structure 12 has the effect of blocking the passage of electromagnetic radiation to the user's head in the vicinity of the antenna 14, and beneficially causing the reflected radiation to act in an additive manner to maximize received or transmitted signals.

The structure 12 can be mechanically arranged either to fold down onto the top of the mobile telephone 10, or to slidingly retract into the body of the telephone 10. The shielding structure also can be shaped as other than a flat plane; for example, it can be curved in the manner of half-cylinder.

Figure 2:
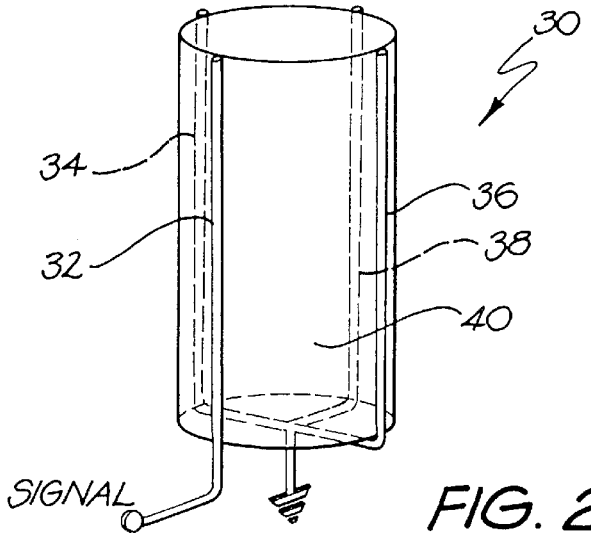
FIG. 2 shows a perspective view of a directional array antenna incorporating parasitic elements.

FIG. 2 shows an antenna arrangement 30 that can be used in direct substitution for known antenna configurations, for example, in cellular mobile telephones. The antenna 30 has four equally spaced quarter-wavelength monopole elements 32–38 mounted onto the outer surface of a dielectric cylinder 40. Most usually, the cylinder 40 will be solid.

Figure 2A:
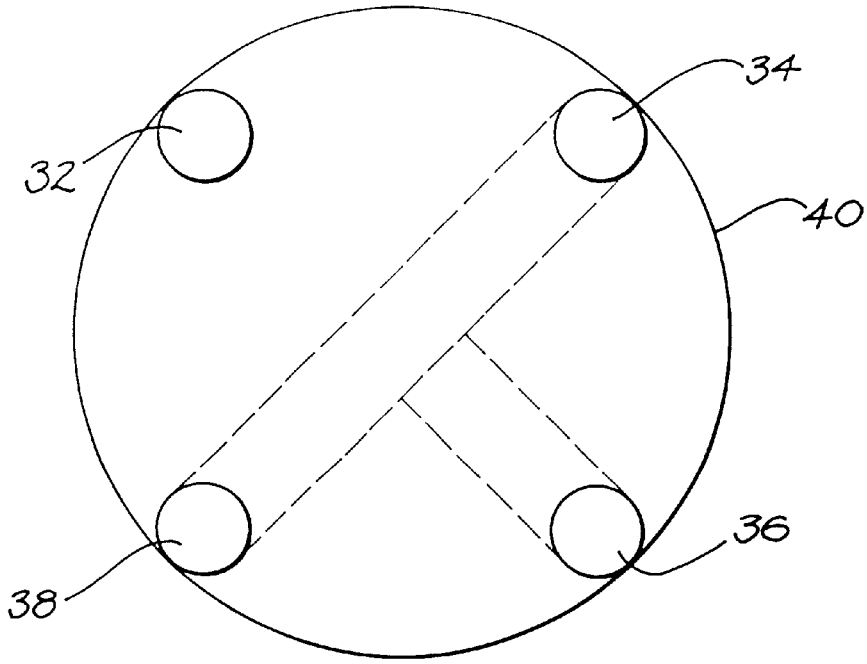
FIG. 2*a* is a top view of a directional array antenna including a dielectric structure wherein the antenna elements are embedded in the dielectric structure.

Note also, that a shape other than a cylinder equally can be used. In a similar way, the elements 32–38 need not be regularly arranged. The only practical requirement is that the dielectric structure be contiguous. The elements 32–38 also can be embedded within the dielectric cylinder 40, or, for a hollow cylinder, mounted on the inside surface. For example, as illustrated in FIG. 2*a*, the plurality of antenna elements 32,34,36 and 38 are embedded within the surface of the dielectric cylinder 40. What is important is that there be no air gap between each of the elements and the dielectric cylinder.

Only one of the monopole elements 32 is active for reception and transmission of electromagnetic radiation (RF signals). The other three monopole elements 34–48 are passive/parasitic, and commonly connected to ground. The antenna arrangement 30 exhibits a high degree of directivity in a radially outward direction coincident with the active element 32, with the three parasitic elements tending to act as reflector/directors for incident RF signals, as well as constituting a form of shielding. The scientific principles underpinning these performance benefits will be explained presently, and particularly with respect to the antenna configuration shown in FIG. 3.

The antenna 30 is suitable for use with mobile cellular telephones as noted above, and can be incorporated wholly within the casing of conventional mobile telephones. This is possible due to the antenna's reduced physical size (with respect to the prior art), and also permits direct substitution for conventional antenna configurations.

Size is an important design consideration in cellular telephones. A long single wire antenna (for example, an end feed dipole or a ¾ wavelength dipole antenna) distributes the RF energy so that head absorption by the user is reduced. The antenna also is more efficient due to a larger effective aperture. The longer the antenna is, however, the less desirable it is from the point of view of portability and mechanical stability. The antenna shown in FIG. 2 can achieve the same performance characteristics as the noted larger known types of antenna, but has the added advantage of being physically small.

Figure 3A:
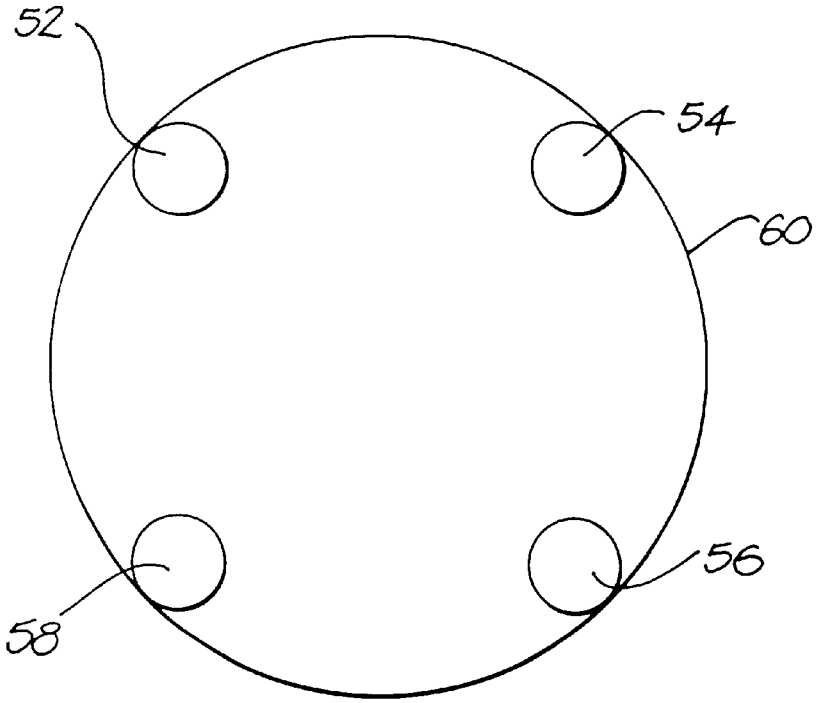
FIG. 3*a* is a top view of a directional array antenna including a dielectric cylinder wherein the antenna elements are embedded in the dielectric cylinder.
Figure 3:
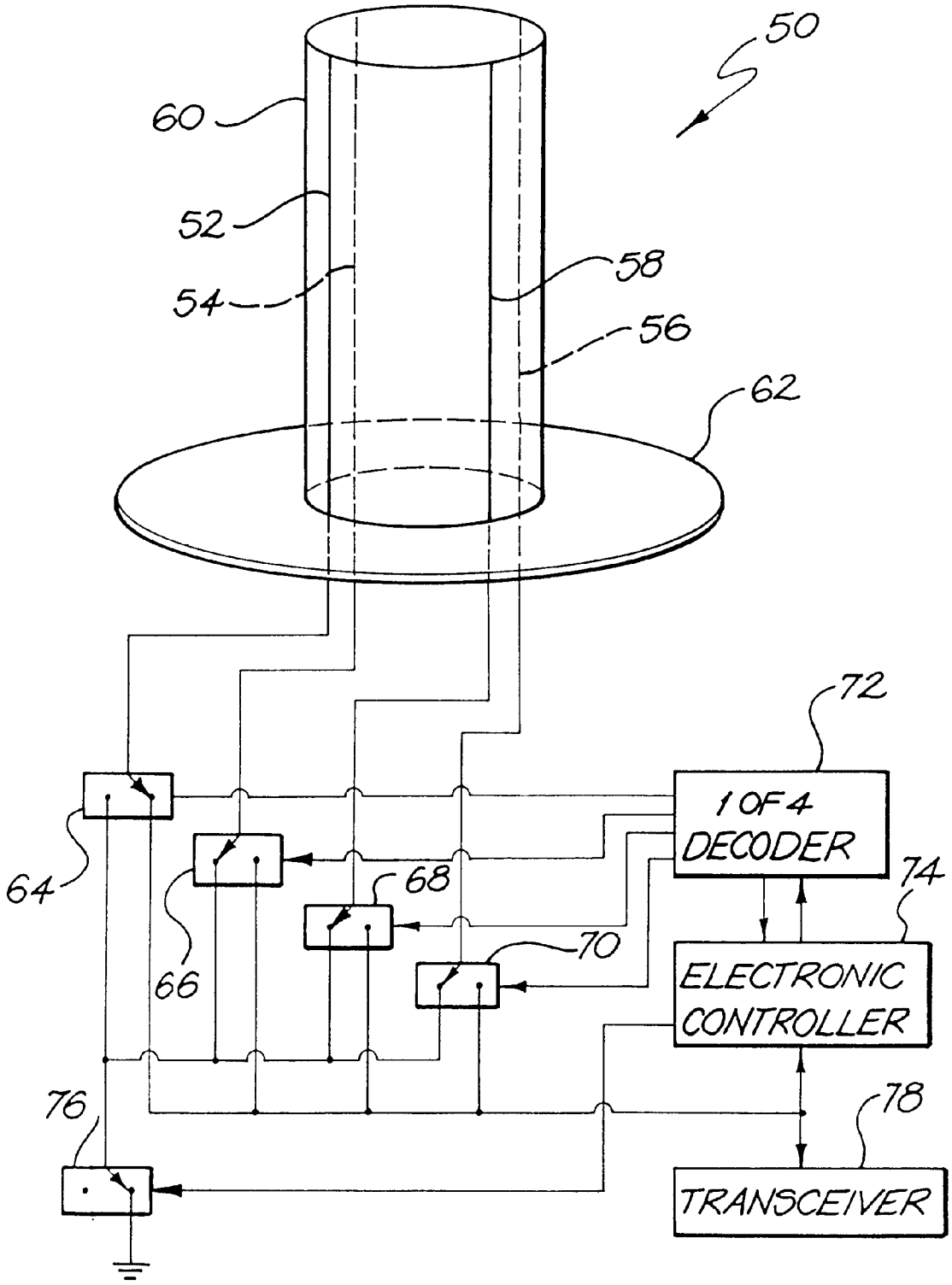
FIG. 3 shows a perspective view of a directional array antenna together with connected switching electronics.

The antenna arrangement 50 shown in FIG. 3 has four equally spaced quarter-wavelength monopole elements 52–58 mounted on the outer surface of a solid dielectric cylinder 60. The monopoles 52–58 again can be embedded in the dielectric cylinder's surface, or the dielectric structure can be formed as a hollow cylinder and the monopole elements mounted to the inner surface thereof, although such an arrangement will have lower directivity since the relative dielectric constant of 1.0 of the air core will reduce the overall dielectric constant. For example, as illustrated in FIG. 3*a*, the plurality of antenna elements 52 are embedded within or positioned on the inner surface of the dielectric cylinder 60.

The cylinder 60 is constructed of material having a high dielectric constant and low loss tangent such as alumina which has a relative dielectric constant $\in_r > 10\in_0$. Alternatively, it can be formed from an artificial dielectric material comprising metallic particles distributed through an insulating medium, or photonic band gap material comprising shaped metal surface insulated from the elements.

The monopoles 52–58 form the vertices of a square, viz., are in a regular array, and oriented perpendicularly from a circular conductive ground plane 62. The monopoles 52–58 lie close to the centre of the ground plane 62. The ground plane is not essential to operation of the antenna 50, but when present serves to reduce the length of the monopole elements.

A conductor embedded in a dielectric material has an electrical length reduced by a factor proportional to the square root of the dielectric constant of the material. For a conductor lying on the surface of an infinite dielectric halfspace with a relative dielectric constant $\in_r$, the effective dielectric constant $\in_{eff}$, is given by the expression: $\in_{eff}=(1+\in_r)/2$.

If the conductor lies on the surface of a dielectric cylinder and parallel to its axis, and there are other conductive elements parallel to it, the effective dielectric constant is modified still further. Factors which influence the effective dielectric constant include the cylinder's radius, and the number and proximity of the additional elements.

In the case of a relative dielectric constant, $\in_r=100$, the length of the monopoles 52–58 can physically be reduced by the factor of approximately seven when the cylinder diameter is greater than 0.5 free space wavelengths. For example, for an antenna operating at 1 GHz, a quarter wavelength monopole in free air has a physical length of about 7.5 cm, however, if lying on the surface of a dielectric cylinder with $\in_r=100$, the monopole can be reduced in physical size to about 1.1 cm.

Each of the monopoles 52–58 respectively is connected to a solid state switch 64–70. The switches are under the control of an electronic controller 74 and a 1-of-4 decoder 72 that together switch the respective monopoles. One of the monopoles 52 is switched to be active, whilst the rest of the monopoles 54–58 are switched to be commonly connected to ground by their respective switches 66–70 and the master switch 76. This, in effect, is the configuration shown in FIG. 2. The master switch 76 has a second switched state which, when activated, results in the non-active monopoles being short-circuited together without being connected to ground. In this configuration, the passive monopoles 54–58 act as parasitic reflector elements, and the antenna 50 exhibits a directional nature.

Directivity is achieved for a number of reasons. A conductor located some distance from the centre of a dielectric cylinder, yet still further within the cylinder, has an asymmetrical radiation pattern. Further, passive conductors of a dimension close to a resonant length and located within one wavelength of an active element act as reflectors, influence the radiation pattern of the antenna and decrease its resonant length.

By appropriate changes in the length of monopole antennas, the input impedance and the directionality of the antenna 50 can be controlled. For example, for a two element antenna with one element active and the other element shorted to ground, for the smallest resonant length (i.e. when the reactance of the antenna is zero), the H plane polar pattern is similar to a figure of eight, providing the dielectric cylinder's radius is small. For antenna lengths marginally greater than this value, the front to back ratio (directivity) increases significantly.

In another configuration (not specifically shown), the passive monopoles 54–58 can be left in an open circuit condition. This effectively removes their contribution from the antenna (i.e. they become transparent). In this configuration, the antenna is less directional than if the monopoles 54–58 were shorted to ground (or even simply shorted altogether), however the antenna still provides significant directionality due to the dielectric material alone.

The dielectric cylinder 60 also increases the effective electrical separation distance. This is advantageous in terms of separating an active element from an adjacent passive element, which, if short circuited to ground, tends to degrade the power transfer performance of the antenna. Therefore, the effective electrical separation distance between the active monopole 52 and the diametrically opposed passive monopole 56 is given by $d/(\in_r)^{0.5}$, where d is equal to the diameter of the dielectric cylinder 60. The effective electrical separation distance between the active monopole 52 20 and the other passive monopoles 54,58 is given by $d/(2\in_r)^{0.5}$.

The dielectric cylinder 60 also has the effect of reducing the effective length of the monopoles. This means that the mechanical dimensions of the antenna are smaller for any operational frequency than conventionally is the case; the electrical length and separation therefore are longer than the mechanical dimensions suggest. For an operational frequency of around 1 GHz, the size of the monopoles and dielectric cylinder are typically of length 1.5 cm and diameter of 2 cm respectively.

The antenna 50 shown in FIG. 3 also has the capability of being electronically steerable. By selecting which of the monopoles 52–58 is active, four possible orientations of a directional antenna can be obtained.

The steerability of the antenna 50 can be utilised in mobile cellular telecommunications to achieve the most appropriate directional orientation of the antenna with respect to the present broadcast cell site. The electronic controller 74 activates each monopole 52–58 in sequence, and the switching configuration resulting in the maximum received signal strength is retained in transmission/reception operation until, sometime later, another scanning sequence is performed to determine whether a more appropriate orientation is available. This has the advantage of conserving battery lifetime and ensuring maximum quality of reception and transmission. It may also reduce the exposure of a user of a mobile telephone to high energy electromagnetic radiation.

The sequenced switching of the monopoles 52–58 can be done very quickly in analogue cellular telephone communications, and otherwise can be part of the normal switching operation in digital telephony. That is, the switching would occur rapidly enough to be unnoticeable in the course of use of a mobile telephone for either voice or data.

Examples of theoretical and experimental results for a number of antenna arrangements now will be described.

Arrangement A

Figure 4:
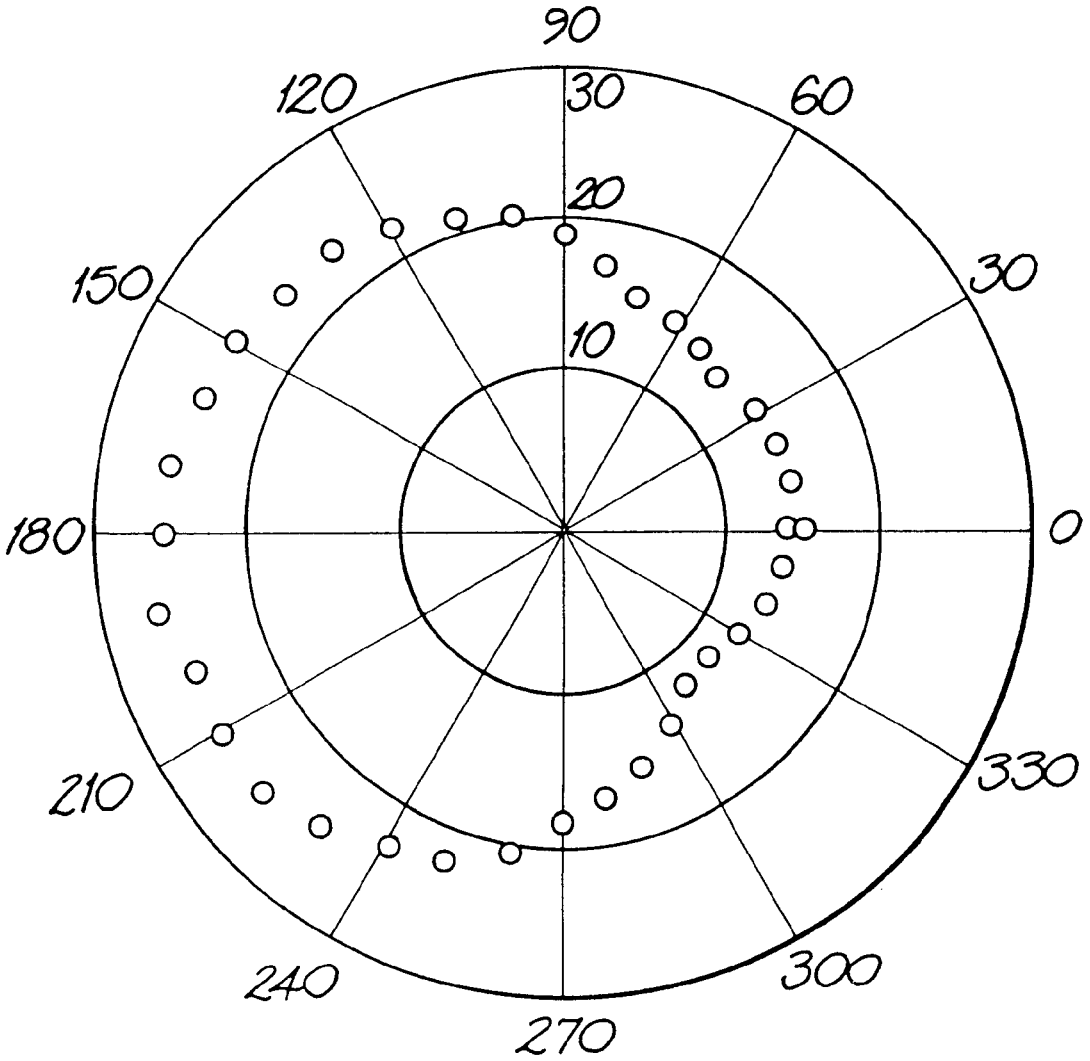
FIG. 4 shows a polar pattern for a limiting configuration of the antenna shown in FIG. 3.

FIG. 4 shows an experimental polar plot of an eccentrically insulated monopole antenna. This is a configuration having a single conductor eccentrically embedded in a material having a high dielectric constant. It could, for example, be constituted by the antenna of FIG. 2 without the three grounded parasitic conductors 34–38. The radial axis is given in units of dB, and the circumferential units are in degrees.

The RF signal frequency is 1.6 GHz, with a diameter for the dielectric cylinder of 25.4 mm and a length of 45 mm. The relative dielectric constant is 3.7. As is apparent, the front-to-back ratio (directivity) of the antenna is approximately 10 dB.

Arrangement B

This arrangement utilises a simplified antenna structure over that shown in FIG. 2. The antenna has two diametrically opposed monopole elements (one active, one shorted to ground) on an alumina dielectric cylinder ($\in_r$=10) having a diameter of 12 mm. The length of each monopole is 17 mm for the first resonance.

Figure 5:
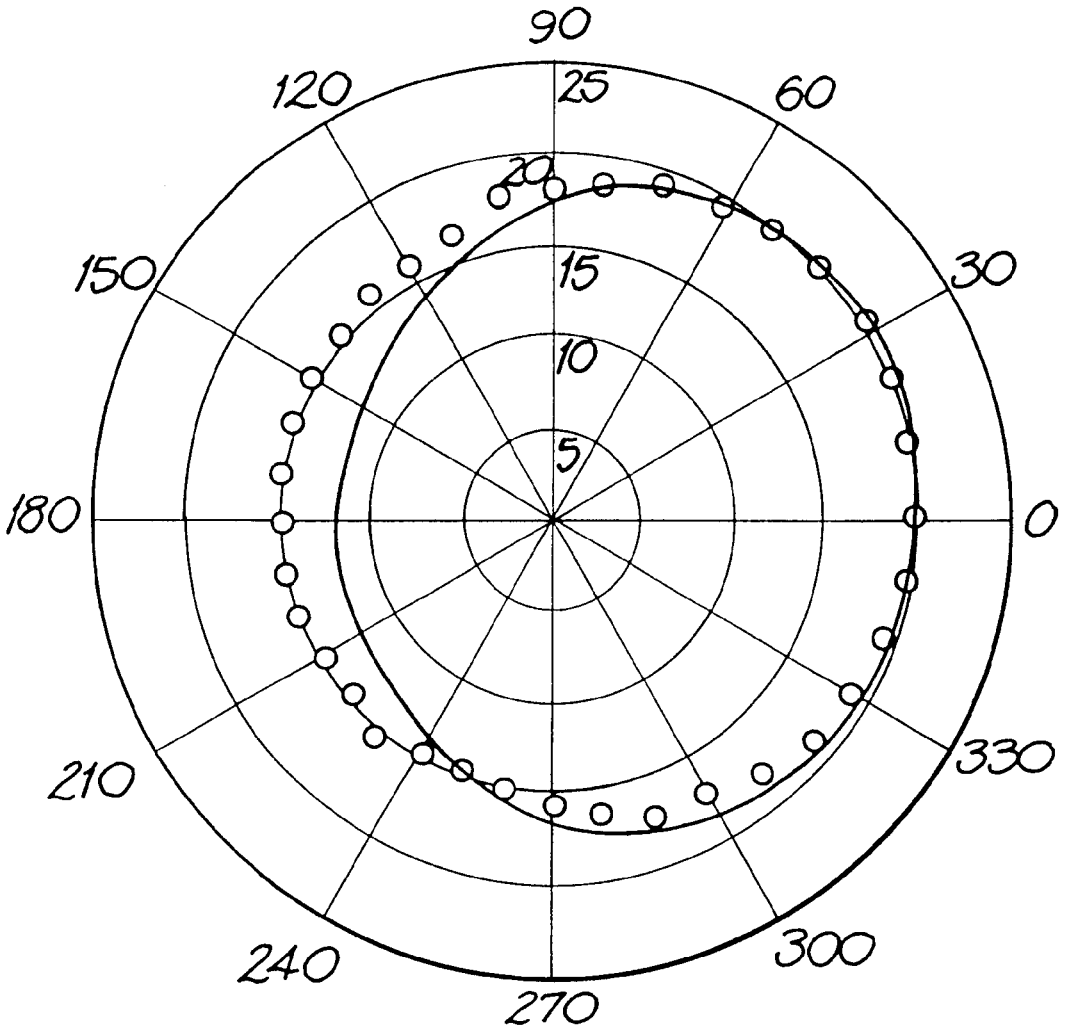
FIG. 5 shows a polar pattern for a modified form of the antenna shown in FIG. 3.

FIG. 5 shows both the theoretical and experimental polar patterns at 1.9 GHz for this antenna. The radial units are again in dB. The theoretical plot is represented by the solid line, whilst the experimental plot is represented by the circled points. At this frequency, the antenna has a front to back ratio of 7.3 dB.

Arrangement C

Figure 6:
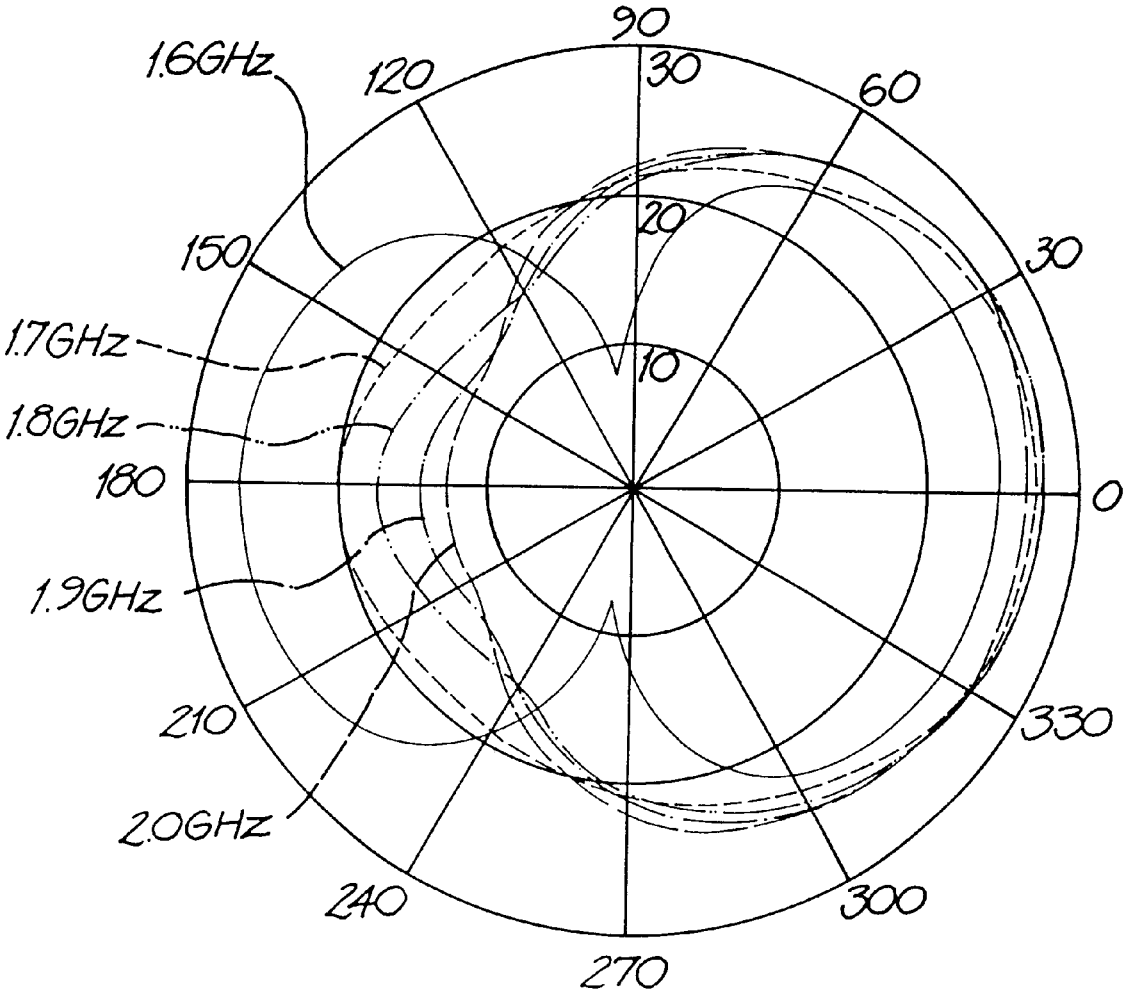
FIG. 6 shows a polar pattern for a particular switched arrangement of the antenna shown in FIG. 3 at different frequencies.

A four element antenna can be modelled using the Numerical Electromagnetics Code (NEC). FIG. 6 shows theoretical NEC polar results obtained as a function of frequency for a four element cylindrical antenna structure similar to that shown in FIG. 2 (i.e. one active monopole and three passive monopoles shorted to ground). The cylinder diameter is 12 mm, the length of the monopole elements is 17 mm and the relative dielectric constant $\in_r$=10.

Note that at 1.6 GHz the antenna is resonant and the polar pattern is a figure of eight shape. For frequencies greater than this, the antenna front-to-back ratio (directivity) becomes larger. This effect also can be induced by increasing the dielectric constant or increasing the diameter of the antenna.

Arrangement D

Figure 7:
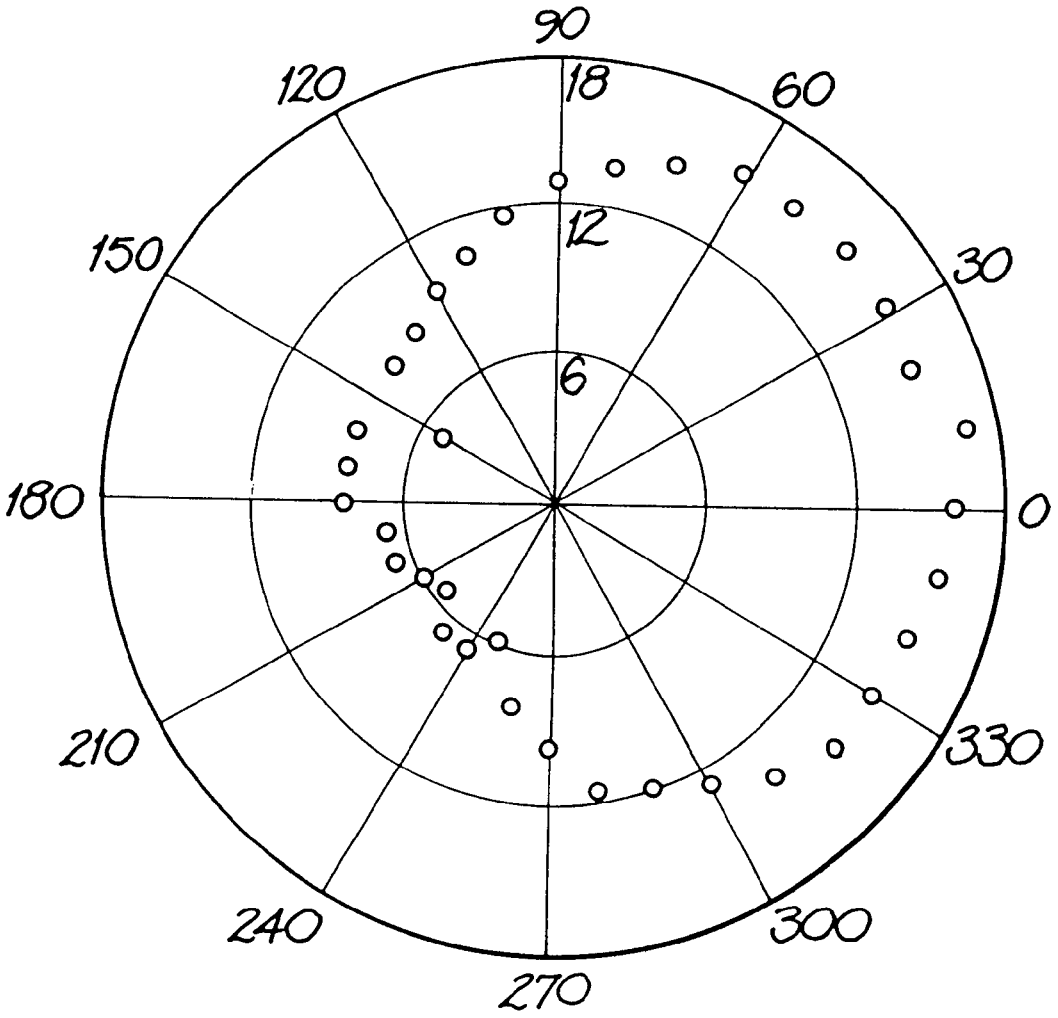
FIG. 7 shows a polar pattern for another switched arrangement of the antenna shown in FIG. 3.

FIG. 7 shows experimental data at a frequency of 2.0 GHz for a four element antenna having the same dimensions as those noted in respect of FIG. 6, which is in general agreement with the corresponding theoretical plot shown in FIG. 6.

In another application relating to ground probing radar, radar transceivers utilise omnidirectional antennas to receive echoes from objects lying within a 180° arc below the position of the antenna. As a traverse is conducted, each object appears with a characteristic bow wave of echoes resulting from side scatter.

Figure 8:
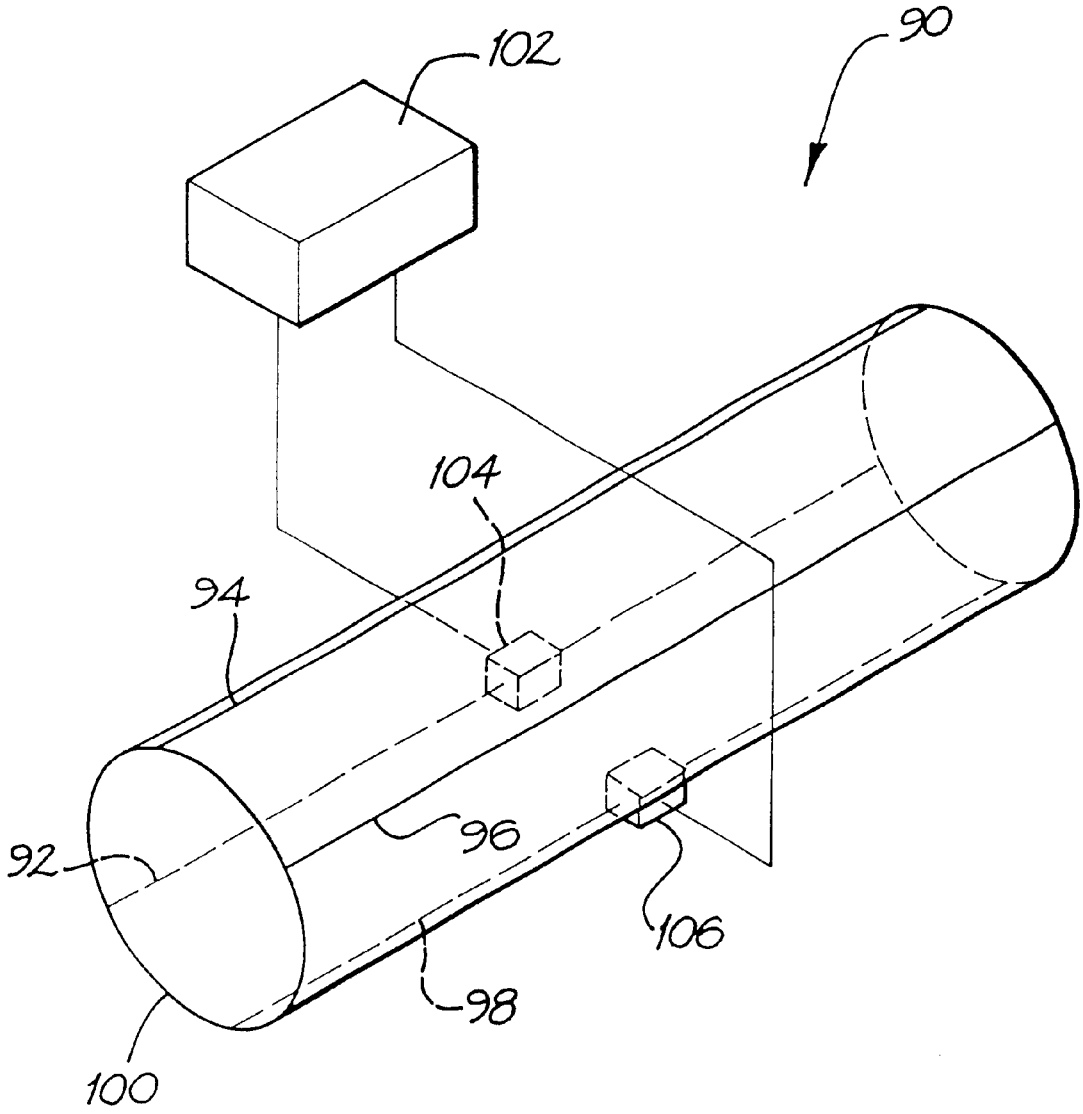
FIG. 8 shows a further embodiment relating to ground probing radar.
Figure 9:
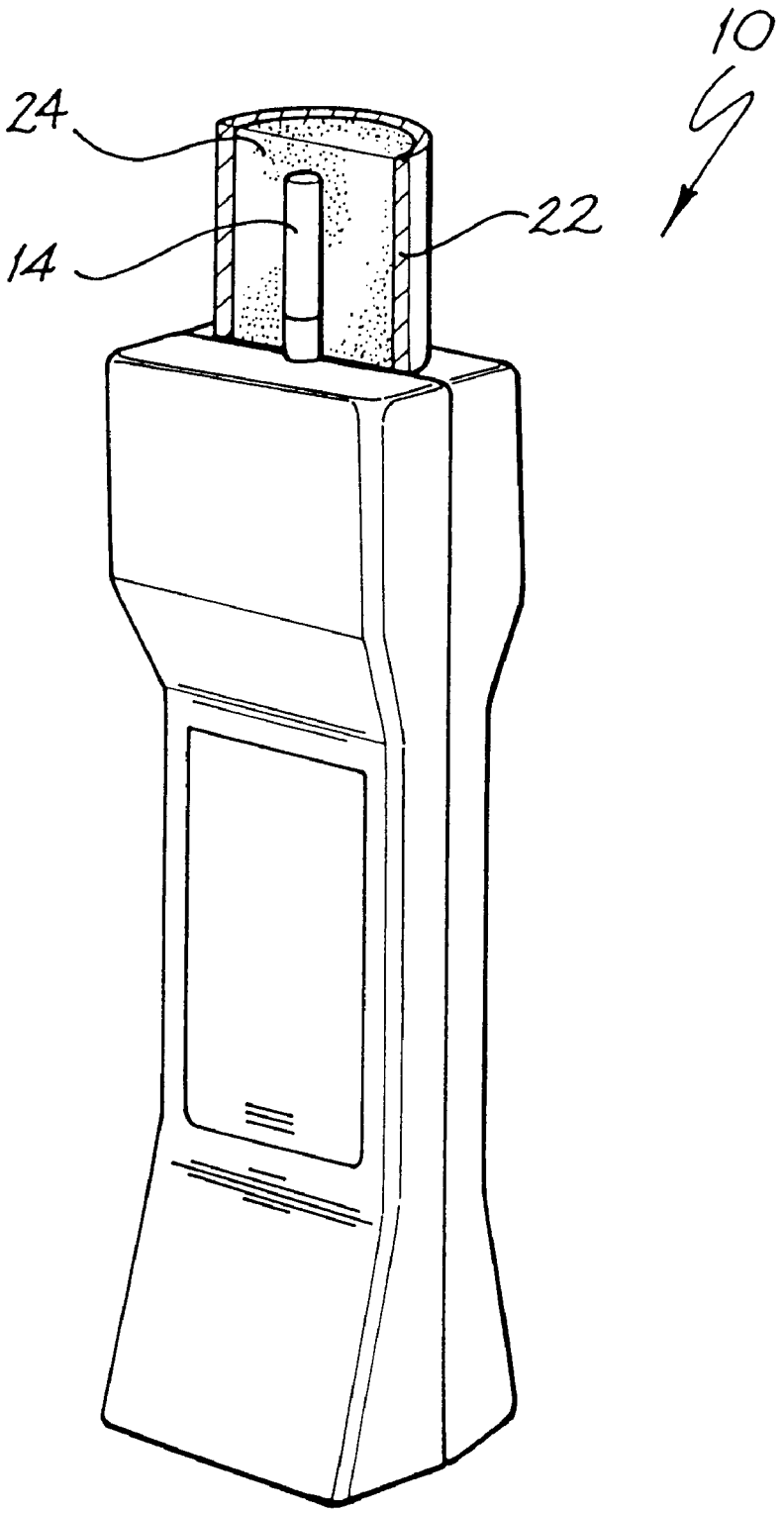
FIG. 9 is a perspective view of a single monopole wire element mounted in a dielectric half cylinder surrounded by a shield according to an embodiment of the present invention.

Another embodiment of an antenna configuration particularly suited for use in ground probing radar is shown in FIG. 8. The antenna 90 incorporates four dipole elements 92–98 arranged on, and fixed to, a dielectric cylinder 100. In this instance no conductive ground plane is required.

In the conduct of ground probing radar studies, two directional orientations of the antenna 90 are used. This is achieved by controlled switching between the driven dipole elements 92,96. Switching is under the control of the electronic controlling device 102 illustrated as a'black box', which controls the two semiconductor switching elements 94,96 located at the feed to the driven dipole elements 92,96. In operation, either driven dipole 92,96 is switched in turn, with the other remaining either open circuit or short circuited to ground. The passive dipole elements 94,98 act as parasitic reflectors, as previously discussed.

By utilising the two switched orientations of the antenna 90 in conducting ground probing radar measurements, the effects of side scatter can be minimised mathematically with processing. This results in improved usefulness of the technique, and particularly improves in the clarity of an echo image received by reducing the typical bow wave appearance.

Further embodiments will now be described.

Figure 11:
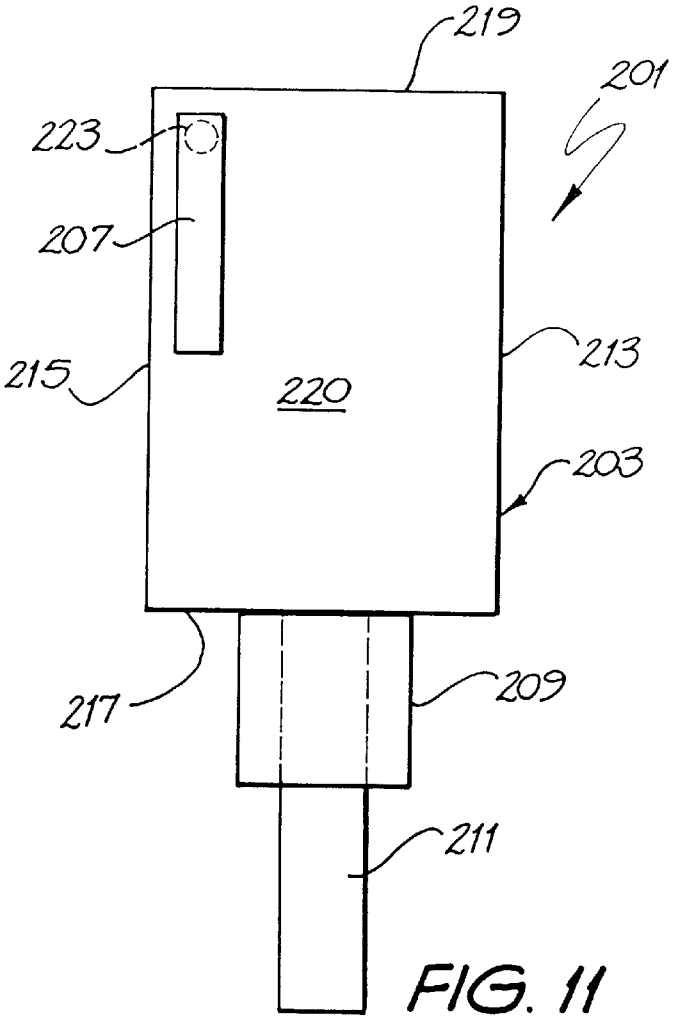
FIG. 11 is a rear elevational view of the directional antenna assembly shown in FIG. 10.
Figure 10:
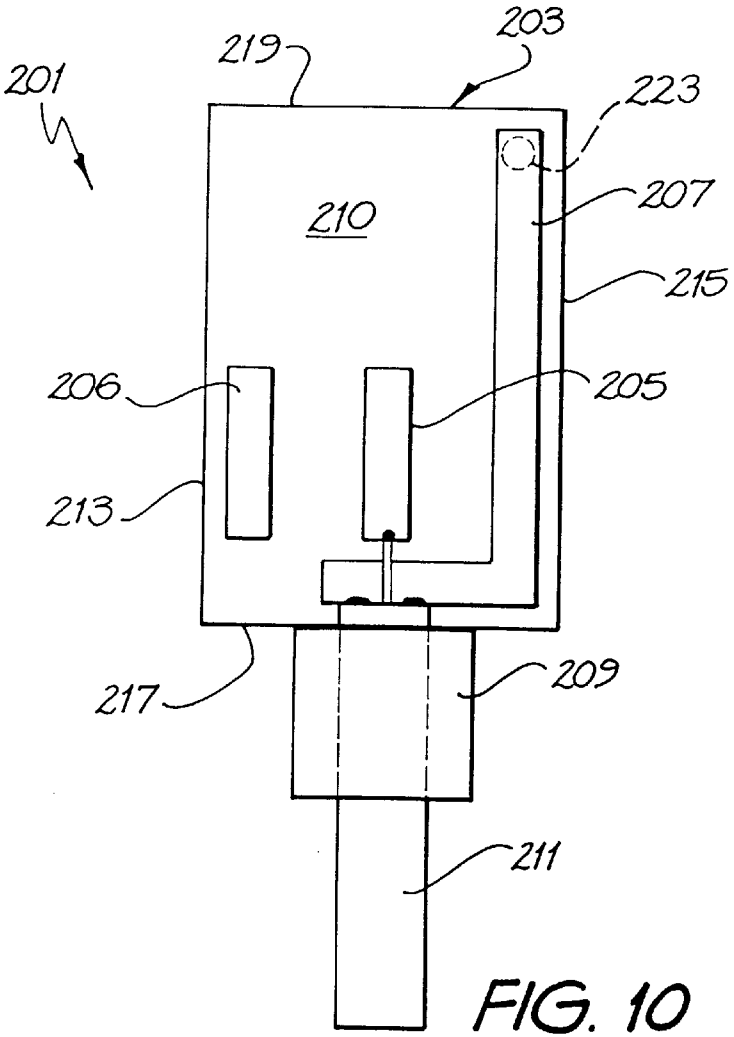
FIG. 10 is a front elevational view of a directional antenna assembly according to another embodiment.

As illustrated in the FIGS. 10 and 11, an antenna assembly 201 includes a substrate 203, three antenna elements 205–207 and a bead 209 which is associated with a coaxial feed line 211. The substrate 203 is of a substantially rectangular configuration. The three elements 205–207 are printed on the front face 210 of the substrate 203 in a substantially parallel arrangement. The centre, (active) element 205 runs along the longitudinal axis of the substrate 203, extending from a point near the base 217 to substantially the centre point of the substrate 203. A grounded reflector (passive) element 207 and a director (passive) element 206 are equally spaced on either side of the centre element 205. As seen in FIG. 10, the director element 206 is of substantially the same length as the centre element 205 and is arranged on the left side 213 of the substrate 203. The reflector element 207 extends from a point near the base of the substrate 203, where it is electrically connected with the signal ground shield of the feed line 211, parallel to the base 217 to a point near the right side 215 of the substrate 203. The reflector element 207 then continues from this point, parallel to the right side 215, to a point near the top 219 of the substrate 203. This arrangement can be considered substantially L-shaped, such that the reflector partially surrounds the centre element 205.

As best seen in FIG. 11, the reflector element 207 also continues onto the rear face 220 of the substrate 203 by a via 223 passing therethrough. On the rear face 219, the director element 207 extends from a point near the top 219 of the substrate 203 to a point substantially half-way between the base 217 and the top 219 of the substrate 203. This arrangement maintains the electrical length of the director element 207 without increasing the overall physical length of the antenna assembly 201.

Figure 12:
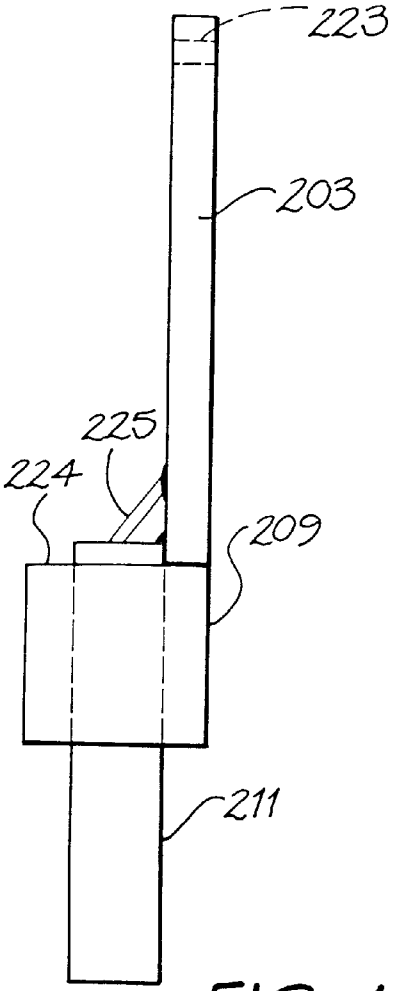
FIG. 12 is a side elevational view of the directional antenna assembly shown in FIGS. 10 and 11.

The bead 209 is of a substantially cylindrical configuration and is arranged at the base 217 of the substrate 203. The substrate 203 is mounted on one edge of the bead 209, as seen in FIG. 12, so that the bead 209 is arranged centrally relative to the base 217 of the substrate 203. The substrate 203 is arranged substantially perpendicular with the top face 224 of the bead 209.

As best seen in FIG. 12, the coaxial feed line 211 runs through the centre of the bead 209 and obtrudes from the top face 224 of the bead 209. The centre (signal) conductor 225 of the coaxial feed line 211 is electrically interconnected with the centre element 205. The outer conductor of the coaxial feed line 211 is electrically interconnected with the reflector element 207.

The substrate 203 is fabricated from a dielectric material, and is preferably at least 1.2 mm thick. In one preferred embodiment the material is a standard PCB material commonly called fibreglass FR4 which has a dielectric constant of 4–5 $\in_O$. A conductor embedded in a dielectric material has an electrical length reduced by a factor proportional to the square root of the relative dielectric constant of the material. The effect of the dielectric0 material is to increase the effective length of the elements 205–207 and to increase the effective spacing between the elements, therefore allowing the antenna assembly 201 to be physically smaller than one constructed of wires in free space. For a conductor lying on the surface of an infinite dielectric halfspace with a relative dielectric constant $\in_r$, the effective dielectric constant, $\in_{eff}$, is approximately given by the expression: $\in_{eff}=(1+\in_r)/2$.

The antenna elements 205–207 are configured on the dielectric substrate 203 in a manner commonly referred to as a Yagi arrangement, namely director(s)—active element—reflector, in the direction of an incoming wavefront. The Yagi arrangement is used in situations where optimised directionality of the transmitted and received antenna signals is required. Further improved directivity is achieved in the above described arrangement due to the effect of the dielectric substrate 203 in that a conductor located on the surface of or within a dielectric has an asymmetrical radiation pattern. Passive conductors of a dimension close to a resonant length and located within one wavelength of an active element act as reflectors, and influence the radiation pattern of the antenna. The centre element 205 excites the antenna structure. The director element 206 has been spaced so as to reinforce the field of the centre element 205, thus providing the antenna with a directional radiation (polar pattern) characteristic. The reflector element 207 is used to optimise the directivity of the antenna by reflecting the electric field of the centre element 205 back toward the director element 206. The above described arrangement may be regarded as an antenna structure which supports a travelling wave whose radiation characteristics are determined by the current distribution in each element of the antenna structure and the phase velocity of the travelling wave.

When used in a cellular mobile telecommunications application, typically at a frequency of 970 MHz, the antenna assembly 201 can have the following representative dimensions.

The substrate of FR-4 material is 1.3 mm thick and 60 mm×25 mm in area. The antenna elements, formed from etched copper tracks, each are 2.0 mm in width; the centre active element is 38 mm in length, the director element 206 is 38 mm in length, and the reflector element 207 is 54 mm in length on the front face 210 and 34 mm in length on the rear face 220. The spacing between the three antenna elements 205, 206, 207 is 10 mm (centre to centre).

All of these distances in copper, scale linearly with frequency to a first approximation. The size of the dielectric substrate 203 is chosen to accommodate the physical lengths of the copper antenna elements 205,206,207.

The position of the via 223 through the substrate 203 controls the lower centre frequency of the antenna. Thought of another way, the length of the grounded reflector element 207 affects the lower centre frequency. The relation is one of decreased length resulting in a higher centre frequency.

The bead 209 is fabricated from any convenient ferrite material and is effective to improve the Q of the antenna, and also reduces the effect of the user's hand on a handset 227 (to which the antenna assembly is attached) on the performance of the antenna.

Figure 13:
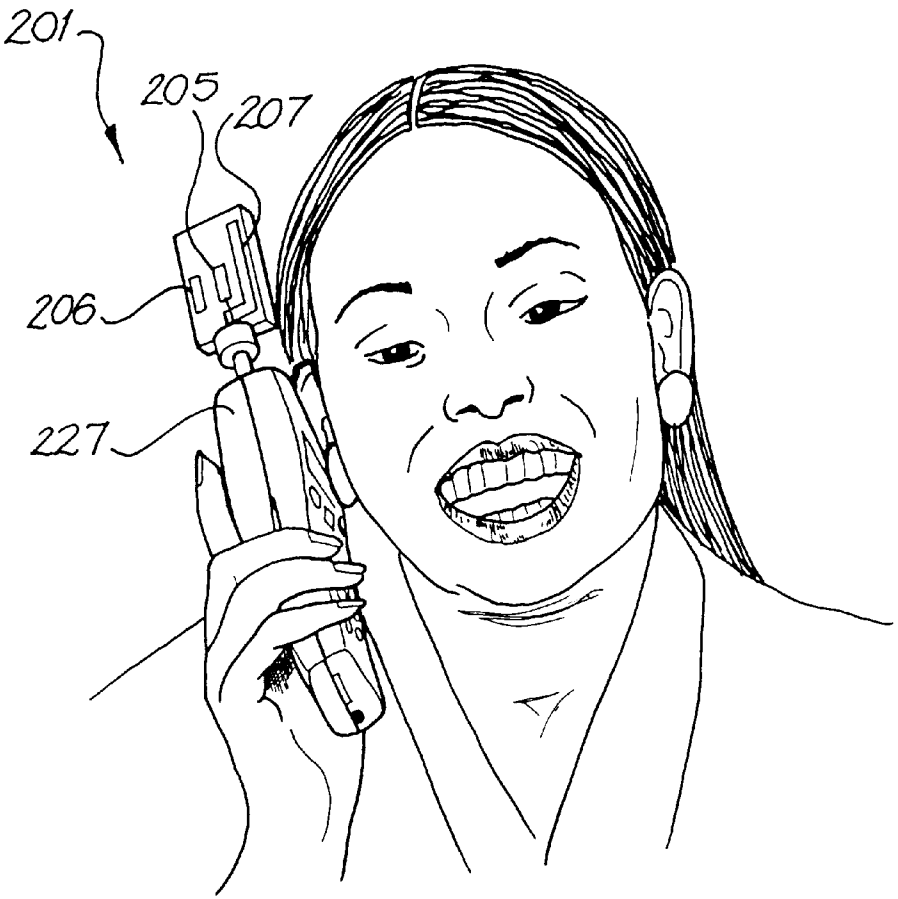
FIG. 13 is a front elevation view of the directional antenna assembly shown in FIG. 10, but showing the directional antenna assembly mounted on a cellular mobile telephone which is in use.

As seen in FIG. 13, in its normal operating position the antenna assembly 201 is to be aligned generally perpendicular to the head of the user. In this position, the reflector element 207 is the closest element to the user with the centre element 205 and the director element 206 each positioned respectively further away from the user.

FIGS. 10 to 13 show an antenna assembly 201 that can be used in direct substitution for known antenna configurations, for example, in cellular mobile telephones. The assembly 201 can be mechanically arranged to fold down onto the top 229 of the mobile telephone handset 227.

The antenna assembly 201 described has a reduced physical size with respect to prior art arrangements. As noted previously, size is an important design consideration in hand-held cellular telephones. A long single wire antenna (for example, an end feed dipole or a ¾ wavelength dipole antenna) distributes the RF energy so that head absorption by the user is reduced. The antenna is also more efficient due to a larger effective aperture. The longer the antenna is, however, the less desirable it is from the point of view of portability and mechanical stability. The dielectric substrate 203 of the preferred embodiment has the effect of reducing the effective electrical length of the elements 205–207. This means that the mechanical dimensions of the antenna assembly 201 are smaller for any operational frequency than is conventionally the case; the electrical length and separation therefore are longer than the mechanical dimensions suggest. Therefore, the antenna assembly 201 as seen in FIG. 10, can achieve the same performance characteristics (ie. forward and backward gains, input impedance, bandwidth, front-to-back ratio, and magnitude of minor lobes) as the noted larger known types of antenna, but has the added advantage of being physically small.

Figure 14:
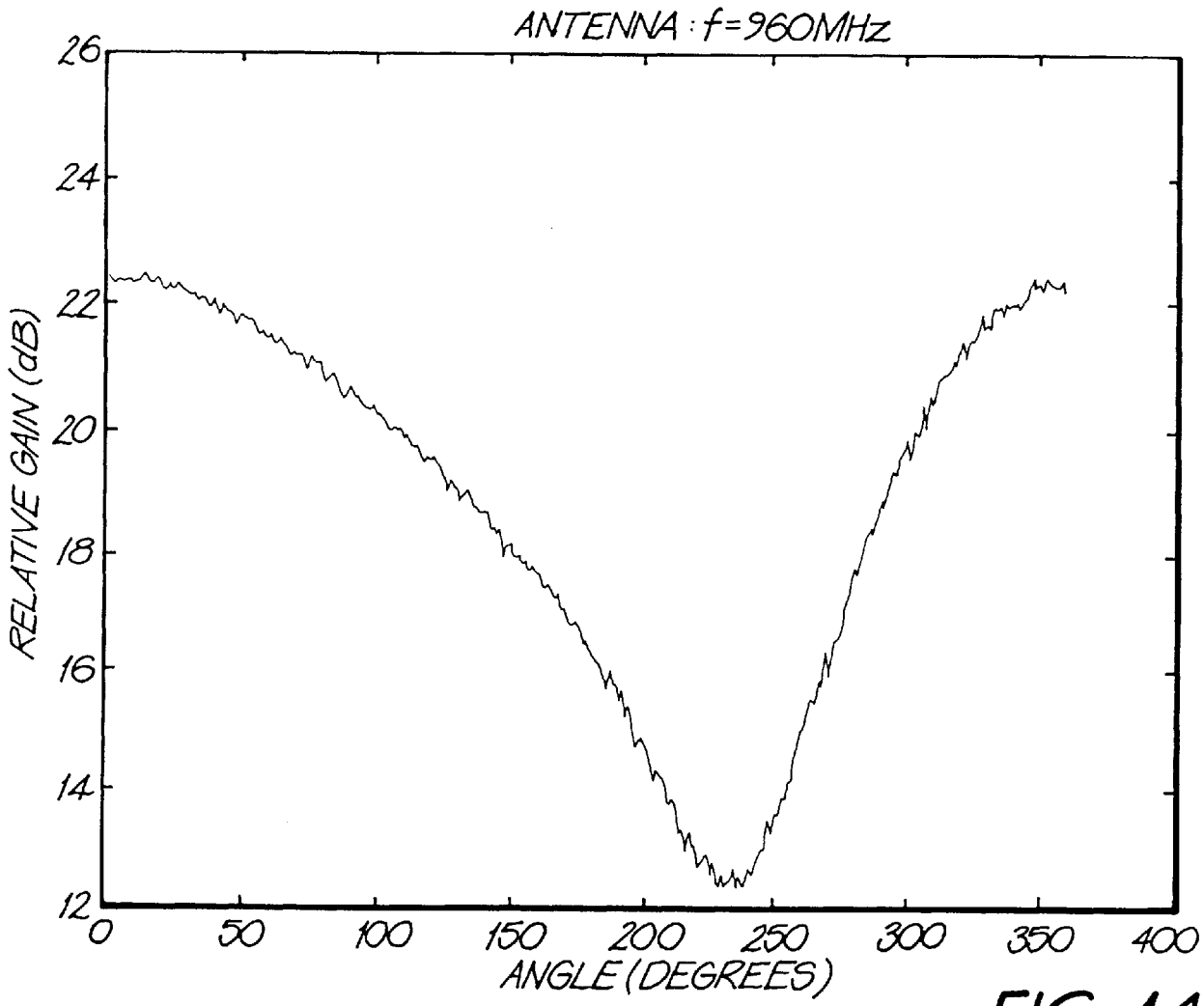
FIG. 14 shows a radiation pattern for the directional antenna of FIGS. 10–13.

The directional properties of the antenna assembly 201 are shown in FIG. 14, having a front-to-back ratio of 210 dB, for a frequency of 960 MHz.

Figure 15:
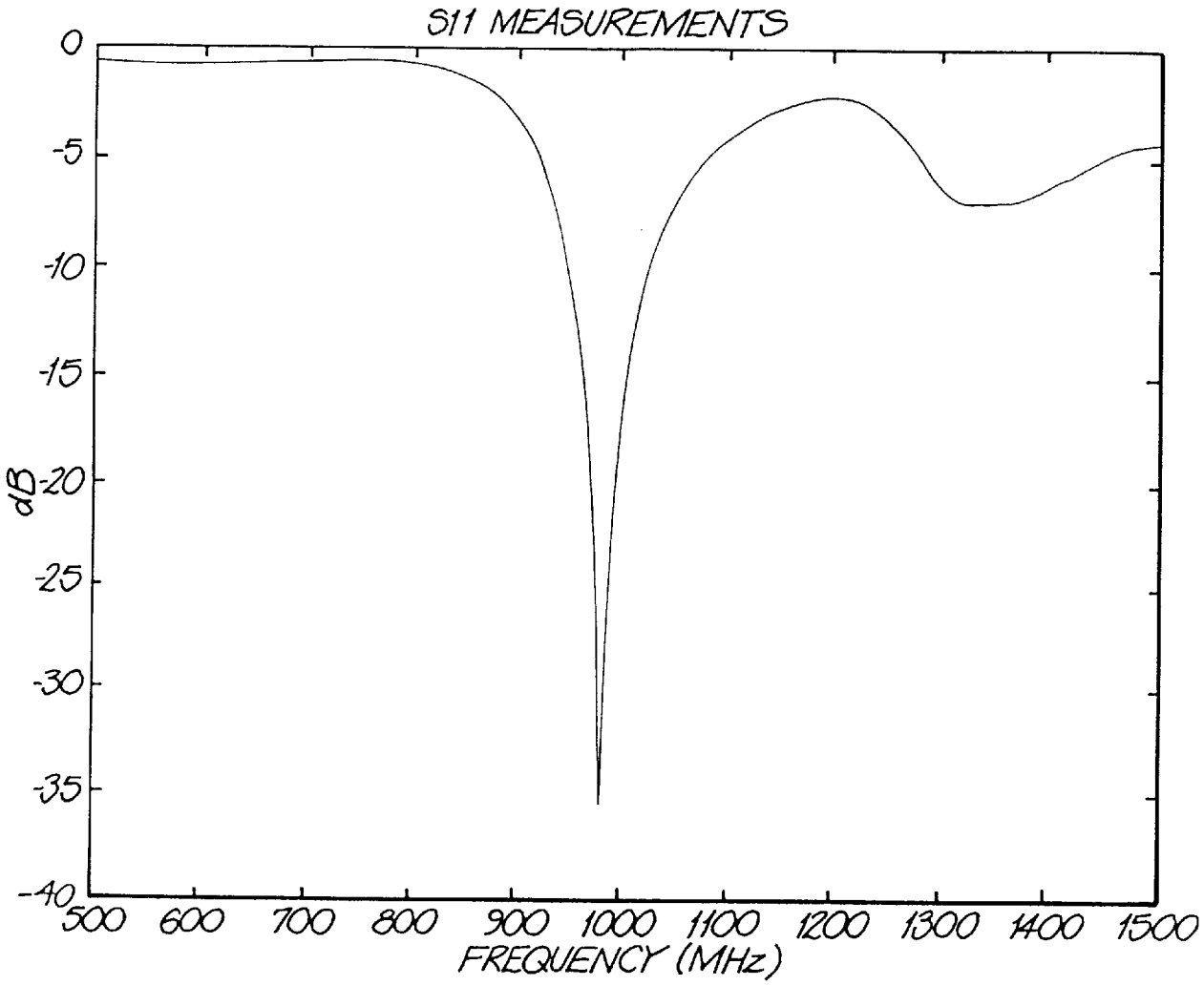
FIG. 15 is an impedance plot showing the impedance of the antenna of FIGS. 10–13.

The impedance properties of the antenna assembly 201 are shown in FIG. 15 as S11 measurements relative to a 50 ohm cable. The S11 at the resonant frequency is −35 dB, and the 10 dB bandwidth is 80 MHz. FIG. 15 illustrates a second resonance at 1.3 GHz. This performance makes the antenna suitable also for use in a dual band mode, as will be presently discussed.

In a further embodiment, the antenna assembly 201 can be mechanically arranged to swivel about its base 217, as seen in FIGS. 16 to 20.

Figure 18:
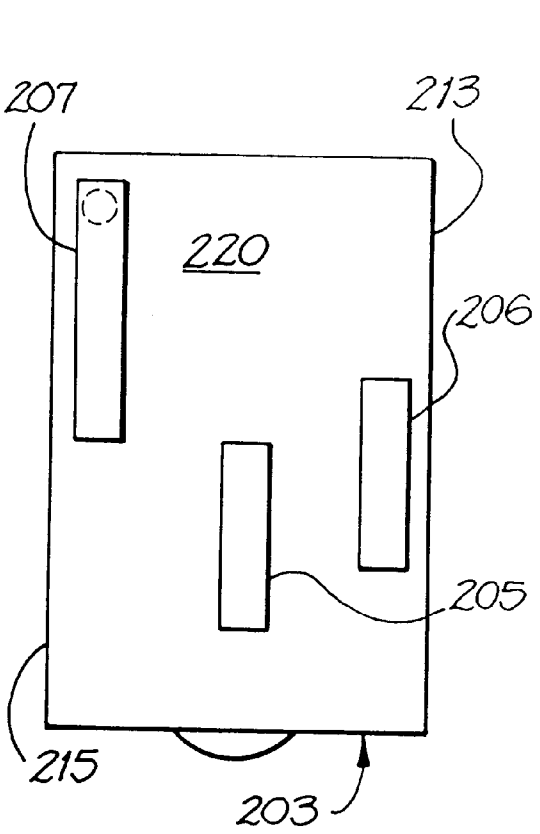
FIG. 18 is a rear elevational view of the directional antenna assembly shown in FIG. 16.
Figure 17:
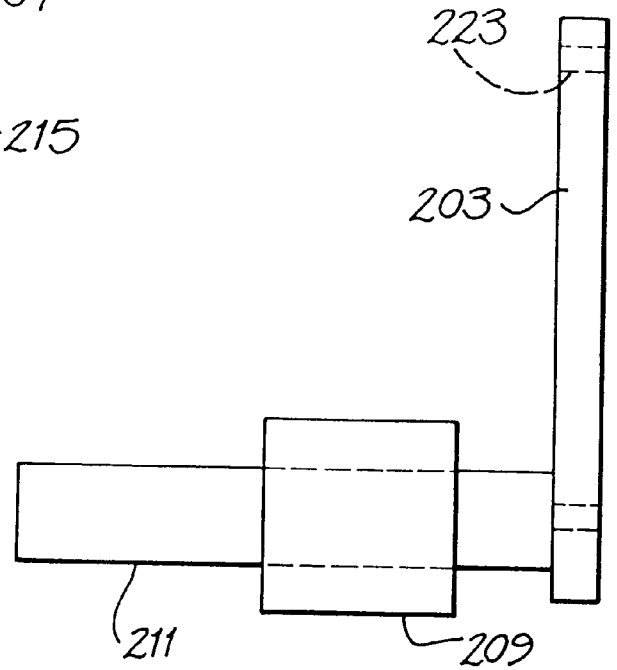
FIG. 17 is a side elevational view of the directional antenna assembly according to FIG. 16.
Figure 16:
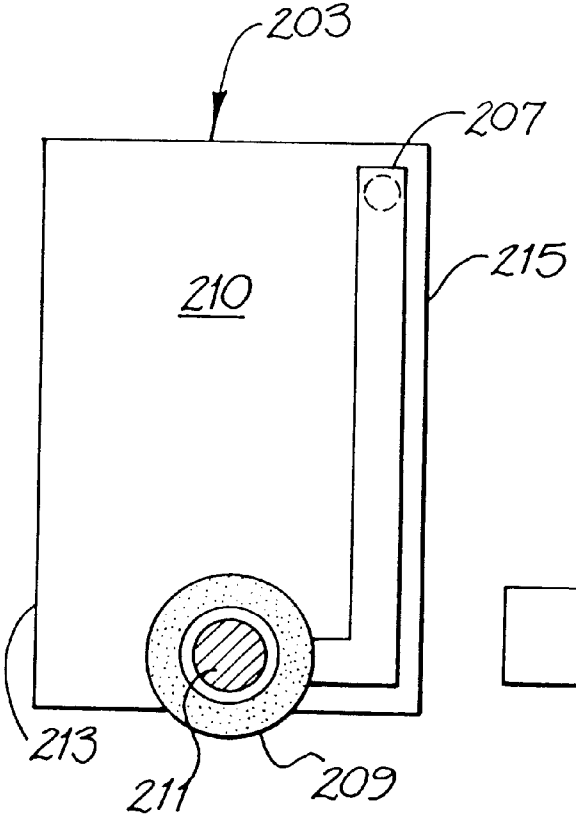
FIG. 16 is a front elevational view of a directional antenna assembly according to another embodiment, being side mounted.

FIGS. 16 and 17 show the coaxial feed 211 running substantially perpendicular to the substrate 203 in this embodiment. The ferrite bead 209 is substantially sandwiched between the substrate 203 and a handset chassis. As seen in FIG. 16, the reflector element 207 is arranged on the substrate 203 in substantially the same manner as in the previous embodiment. However, the centre element 205 and the director element 206 are arranged on the rear face 220 of the substrate 203, as seen in FIG. 18. This arrangement minimises coupling of the radio frequency energy into the chassis of the handset 227.

Figure 19:
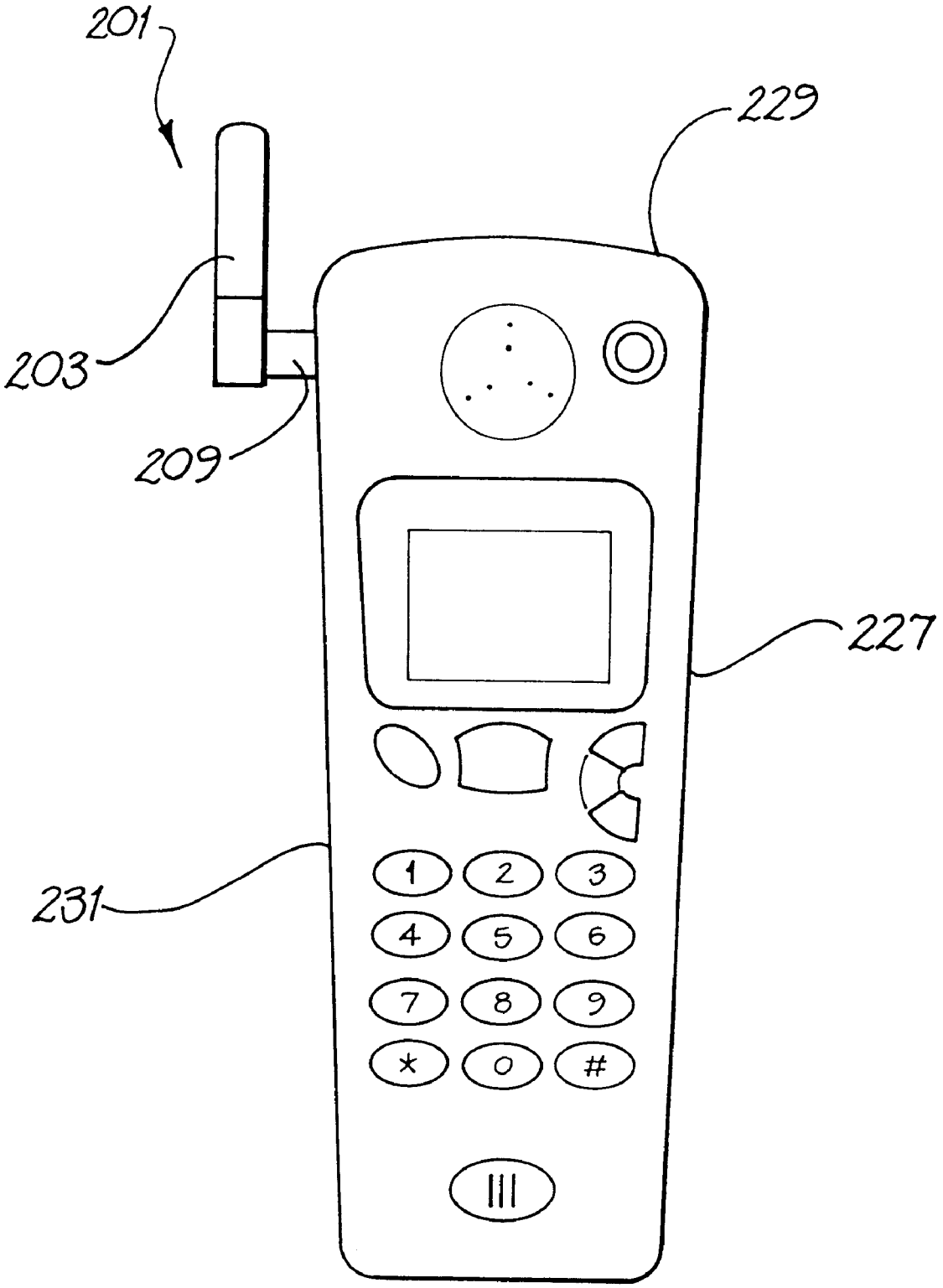
FIG. 19 shows the antenna assembly pivoted to be aligned with the side of the mobile cellular telephone when in use.
Figure 20:
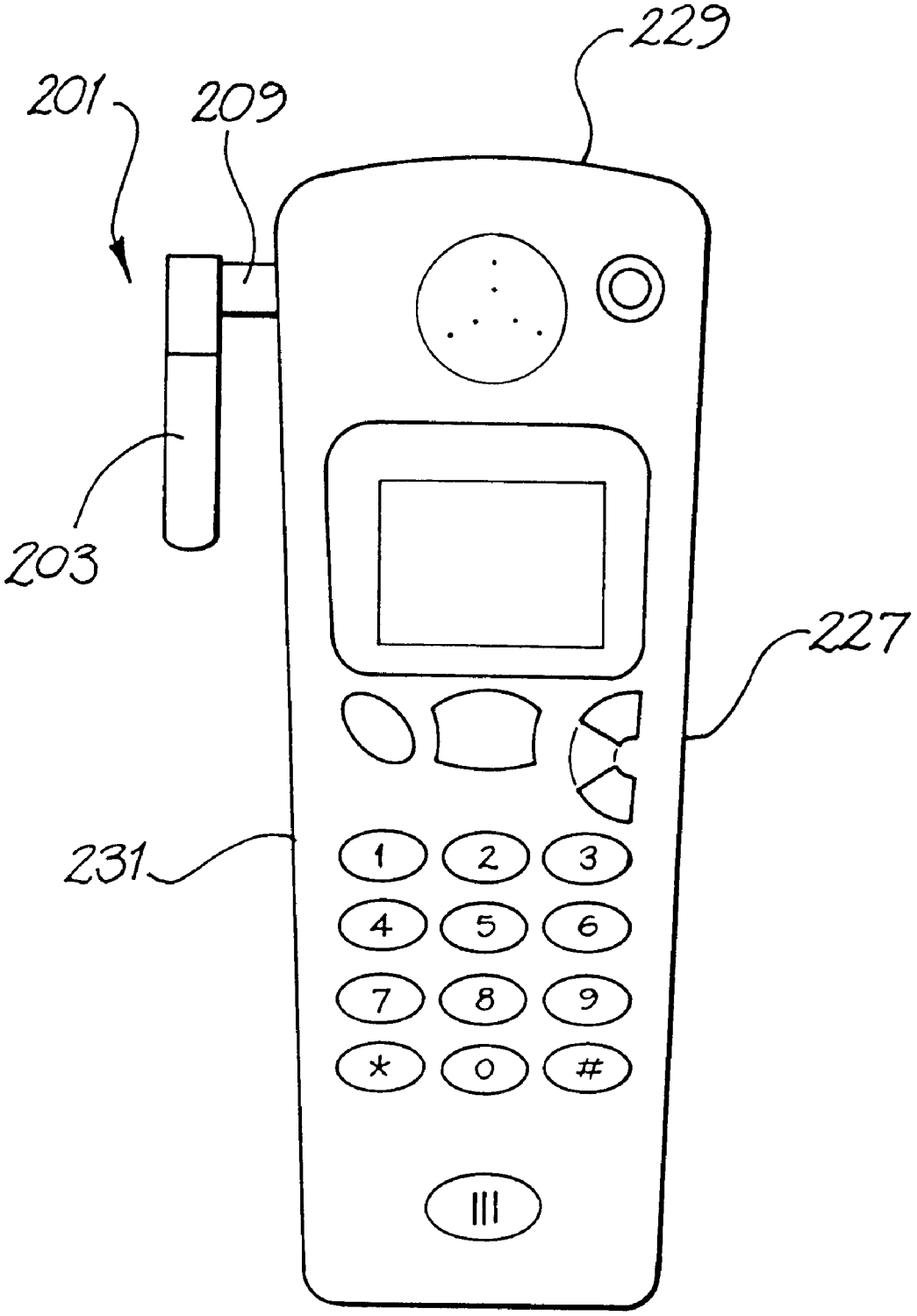
FIG. 20 is a view similar to FIG. 19 but showing the antenna assembly pivoted down to be aligned with the side of the mobile cellular telephone when not in use.

In FIG. 19, the antenna assembly 201 shown in its extended in-use position relative to the handset 227, such that the pivoting point located on the side 231 means that the antenna assembly 201 extends above the top 229 of the handset 227. In FIG. 20 the attachment point to the side 231 is such that the antenna assembly extends to be flush with the top 229 of the handset 227 when not in use.

As discussed with reference to FIG. 15, the antenna assembly embodying the invention has a second resonance, making it suitable for operation as a dual frequency antenna. Dual frequency mobile communications will operate at frequencies in the range of 900 MHz and 1.8 GHz. Embodiments of the invention can be 'tuned' so as to be suitable for operation in both of the frequency ranges mentioned.

Figure 21:
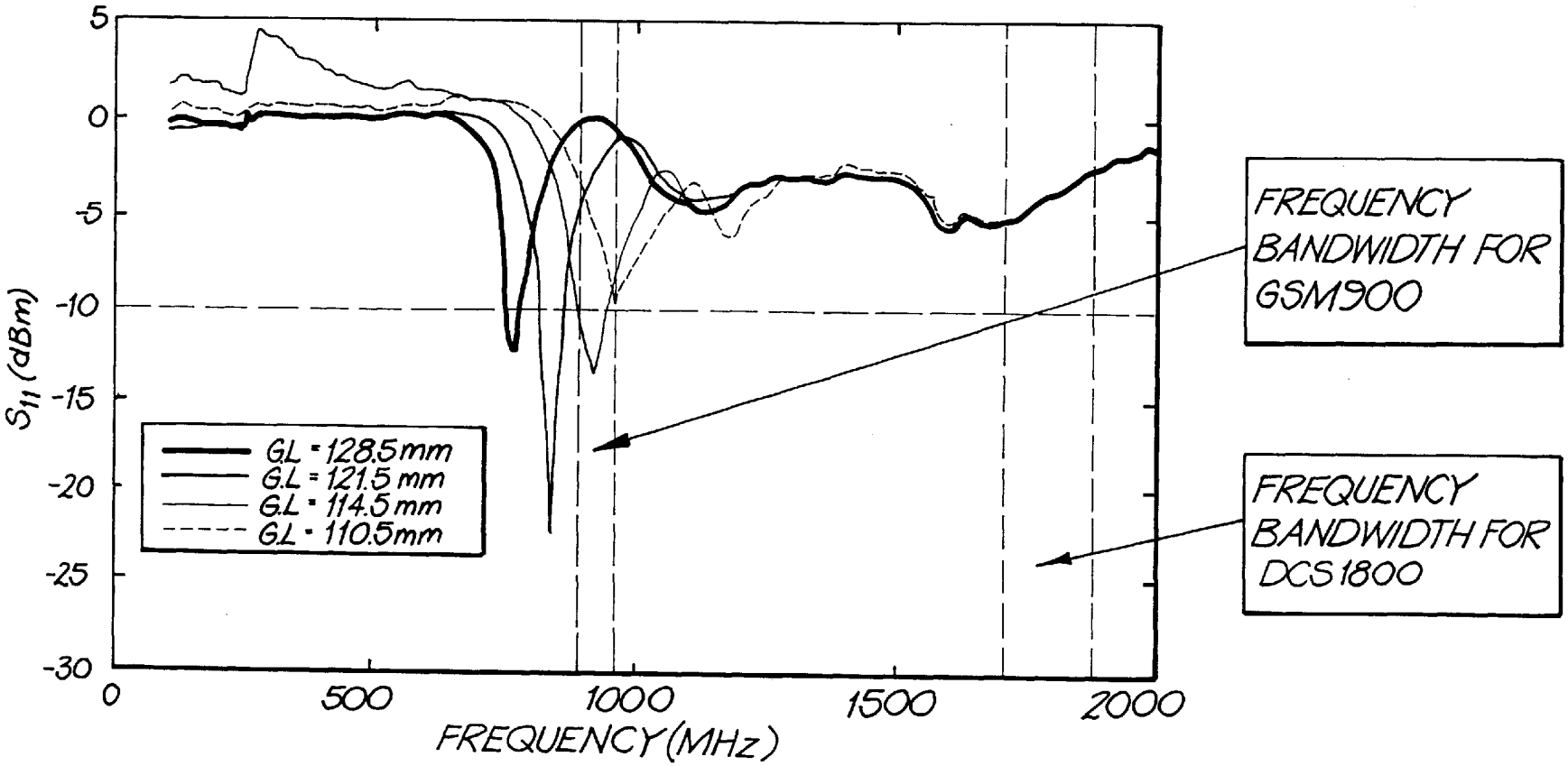
FIG. 21 shows plots of antenna impedance as a function of ground line length.
Figure 22:
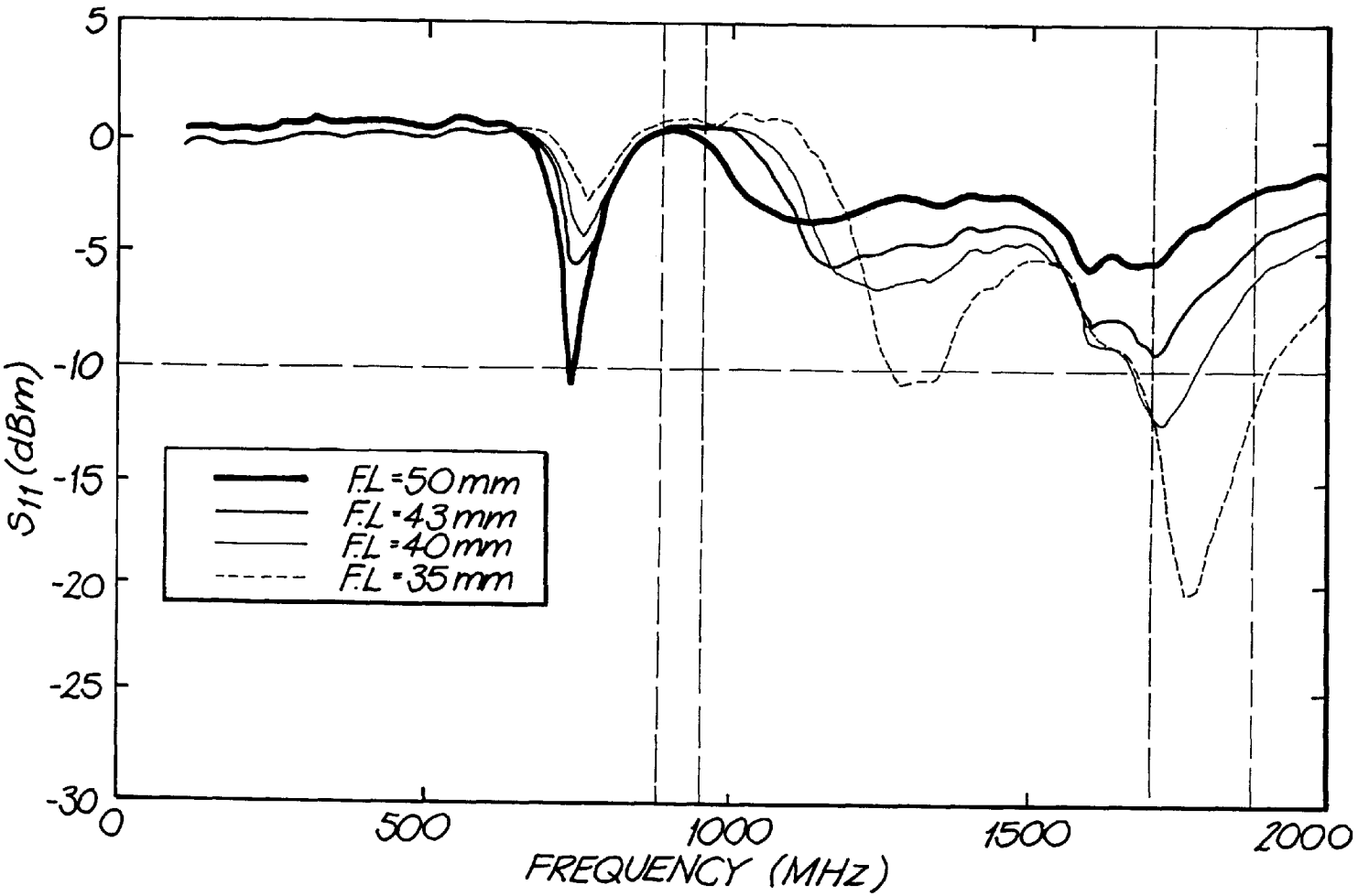
FIG. 22 shows plots of antenna impedance as a function of feed line length.

FIG. 21 shows a plot of antenna impedance as a function of the length of the 'ground line' (being the total length of the grounded reflector element 207 on the front and back faces), demonstrating how the lowest centre frequency can be shifted and still overlap with the GSM900 frequency bandwidth. FIG. 22 shows the variation in antenna impedance characteristics as a function of the length of the feed line (i.e. the driven centre element 205) on the strength of the upper resonance in the region of the DSCS1800 frequency bandwidth region. Accordingly, an appropriate choice of active element and reflector element dimensions can result in an antenna that is able to service dual frequency mobile telecommunications systems.

As noted above, there are presently concerns about the effect of very high strength electromagnetic fields associated with mobile cellular telephone antennas, on brain tissue. The overall improved directionality and efficiency of the antenna assemblies described means that the magnitude of radiation that is directed towards the head of the user of the mobile telephone is greatly reduced. In this connection the embodiments of the invention offers greater protection to users of mobile telephones than prior arrangements.

The foregoing describes only one embodiment of the present invention and modifications, obvious to those skilled in the art, can be made thereto without departing from the scope of the present invention. For example, the number of antenna elements is not restricted to three. There may be two or more passive elements acting as directors. Other regular or irregular arrays of monopole or dipole elements, in close relation to a dielectric structure, are also contemplated.

We claim:

1. A directional antenna assembly arrangement comprising:

a dielectric structure having a surface, wherein a ground plane is not positioned in or on the dielectric structure; and an array of wire antenna elements disposed within or on the surface of the dielectric structure, at least one of the wire antenna elements being active and the remainder being passive.

2. A directional assembly arrangement comprising:

a dielectric structure having a surface, wherein the dielectric structure is formed from a material having a relative dielectric constant $\in_r$ of greater than four, and an array of wire antenna elements positioned within or on the surface of the dielectric structure, at least one of the wire antenna elements being active and the remainder being passive.

3. The antenna assembly arrangement of claim 2, wherein $\in_r$ is greater than ten.

4. A directional antenna assembly arrangement comprising:

a dielectric structure having a surface;

an array of wire antenna elements positioned within or on the surface of the dielectric structure, at least one of the wire antenna elements being active and the remainder being passive; and switching means electrically connected to the antenna elements, the switching means being operable to selectively switch one or more of the antenna elements to be active.

5. The antenna assembly arrangement as claimed in claim 4, wherein the passive antenna elements are switched by the switching means either to be electrically connected to ground or in an open circuit condition.

6. The antenna assembly arrangement as claimed in claim 5, wherein the antenna elements are arranged in symmetric array.

7. The antenna assembly arrangement as claimed in claim 6, wherein the dielectric structure is a cylinder.

8. The antenna assembly arrangment as claimed in claim 6, wherein the dielectric structure is a rectangular body.

9. The antenna assembly arrangement as claimed in claim 7, wherein the cylinder is either solid or hollow.

10. The antenna assembly arrangement as claimed in claim 5, wherein the switching means are selectively controlled by control means to cause one or more of the antenna elements to be active in accordance with the direction of greatest received signal strength.

11. The antenna assembly as claimed in claim 5, wherein the relative dielectric constant of the dielectric structure is greater than $\in_0$, where $\in_0$ is the permittivity of free space.

12. The antenna assembly arrangement as claimed in claim 11, wherein the antenna elements are separated by a minimum distance of $$\frac{\lambda_0}{10}\cdot\frac{1}{\sqrt{\varepsilon_r}},$$

where $\lambda_0$ is the wavelength in free space of the electromagnetic radiation to be received or transmitted by the antenna elements, and $\in_r$ is the relative permittivity of the dielectric structure.

13. The antenna assembly arrangement as claimed in claim 12, wherein the length of the antenna elements is greater than.

$$\frac{\lambda_0}{5}\cdot\frac{1}{\sqrt{\varepsilon_r}}.$$

14. An antenna assembly including at least:

a substantially planar structure of dielectric material, wherein a ground plane is not positioned in or on the structure of dielectric material, and an array of at least three antenna elements mounted on a common surface of said structure, the array including an active element having a feed connection point, a first passive element being parallel with and spaced apart from the active element, and a second passive element being parallel with and spaced apart from the first active element in an opposed direction to said first passive element.

15. The antenna assembly as claimed in claim 14, wherein said antenna elements are substantially elongate.

16. A portable communications device having an antenna assembly as claimed in claim 14.

17. The portable communications device as claimed in claim 16, wherein the antenna assembly is mounted from the communications device in a manner such that the plane of the array is perpendicular to a user's head, with the second passive element being proximate thereto.

18. The portable communications device as claimed in claim 17, wherein the antenna assembly is mounted from the communications device in a manner such that the antenna assembly can pivot about its base.

19. An antenna assembly including at least:

a substantially planar structure of dielectric material, and an array of at least three antenna elements mounted on a common surface of said structure, the array including an active element having a feed connection point, a first passive element being parallel with and spaced apart from the active element, and a second passive element being parallel with an spaced apart from the active element in an opposed direction to said first passive element wherein said antenna elements are substantially elongate, wherein said second passive element has a transverse portion substantially L-shaped, and of greater length than the active element to act as a reflector, and said L-shaped second passive element is arranged to at least partially surround the active element.

20. The antenna assembly as claimed in claim 19, wherein the first passive element is equal or lesser length than the active element to act as a director.

21. The antenna assembly of claim 20, wherein said second passive element passes through said dielectric structure and extend over at least a portion of the opposed surface of the structure.

22. The antenna assembly of claim 21, wherein the feed point of the active element is electrically connected with a centre conductor of a coaxial feed line, being at one end of the active element.

23. The antenna assembly of claim 22, wherein the second passive element is electrically connected to a signal ground conductor of the coaxial feed line.

24. An antenna assembly including at least:

a substantially planar structure of dielectric material, and an array of at least three elongate antenna elements mounted on a first surface of said dielectric material, the array including an active element having a feed connection point, a first passive element being parallel with and spaced apart from the active element, and a second passive element being parallel with and spaced apart from the first active element in an opposed direction to said first passive element, said second passive element also extending through the dielectric material to a second surface opposite the first surface.

25. The antenna assembly of claim 24, wherein said second passive element passes through said dielectric material and extends over at least a portion of the second surface of the dielectric material.

26. The antenna assembly of claim 25, wherein said second passive element has, on said first surface, a transverse portion being substantially L-shaped, and of greater length than the active element, to act as a reflector, and said L-shaped second passive element is arranged to at least partially surround the active element.

27. The antenna assembly of claim 26, wherein the first passive element is of equal or lesser length than the active element to act as a director.

28. The antenna assembly of claim 27, wherein the feed point of the active element is electrically connected with a center conductor of a coaxial feed line, being at one end of the active element.

29. The antenna assembly of claim 28, wherein the second passive element is electrically connected to a signal ground conductor of the coaxial feed line.

30. A portable communications device having an antenna assembly as claimed in claim 24.

31. The portable communications device of claim 30, wherein the antenna assembly is mounted from the communications device in a manner such that the plane of the array is perpendicular to a user's head, with the second passive element being proximate thereto.

32. The portable communications device of claim 31, wherein the antenna assembly is mounted from the communications device in a manner such that the antenna assembly can pivot about its base.

* * * * *